US005765515A

United States Patent [19]

Letsche

[11] Patent Number: 5,765,515

[45] Date of Patent: Jun. 16, 1998

[54] CONTROLLABLE HYDRAULIC VALVE OPERATING MECHANISM

[75] Inventor: Ulrich Letsche, Stuttgart, Germany

[73] Assignee: Daimler-Benz AG, Stuttgart, Germany

[21] Appl. No.: 858,431

[22] Filed: May 19, 1997

[30] Foreign Application Priority Data

May 31, 1996 [DE] Germany ..... 196 21 951.5

[51] Int. Cl.[6] ..... F01L 9/02

[52] U.S. Cl. ..... 123/90.12; 137/906; 251/25

[58] Field of Search ..... 123/90.12, 90.13, 123/90.14, 90.15; 91/356, 392, 461; 137/906; 251/25, 31

[56] References Cited

U.S. PATENT DOCUMENTS 5,193,495 3/1993 Wood, III ..... 123/90.12
5,248,123 9/1993 Richeson et al. ..... 123/90.12
5,595,148 1/1997 Letsche et al. ..... 123/90.12

FOREIGN PATENT DOCUMENTS 2 297 124 7/1996 United Kingdom .

*Primary Examiner*—Weilun Lo
*Attorney, Agent, or Firm*—Klaus J. Bach

[57] ABSTRACT

In a hydraulic operating mechanism for a valve which comprises a valve stem with first spring means acting on the valve stem in the valve closing direction, and second spring means acting at least intermittently on the valve stem in a valve opening direction, the compressing force of the second spring means is controlled hydraulically during the operation of the valve control device. In order to keep the control forces required for operating the valve as low as possible over its entire operating range, the second spring means comprises a spring combination composed of at least two springs which have different spring forces providing for a maximum spring force of the second spring means at the start of the valve opening stroke.

11 Claims, 4 Drawing Sheets

CONTROLLABLE HYDRAULIC VALVE OPERATING MECHANISM

The invention relates to a freely controllable hydraulic valve operating mechanism especially for an internal combustion engine.

BACKGROUND OF THE INVENTION

DE 195 01 495 C1 discloses a controllable hydraulic valve operating mechanism which comprises a valve, having a valve stem and a helical compression spring acting on the latter in the valve-closing direction, and an oil-pressure spring acting intermittently on the valve stem in the valve opening direction. The valve control device comprises a control piston which is arranged in a working space to which a working fluid can be admitted. In the region of each of its end positions the piston partially delimits a pressure space which is part of the working space and which can be separated hydraulically from the latter. The pressure of the working fluid in the working space can be controlled via a pressure source and a supply line including an electronically actuated switching valve. A second spring means is pre-stressed providing a force which can be controlled during the operation of the valve control device. When the working fluid in the working space is not under pressure and the second spring means relaxed, the lifting valve is held in a closed position by the first spring means.

Reference is also made to DE 38 36 725 C1 for general technical background.

It is the object of the present invention to provide an improved controllable hydraulic valve operating mechanism which requires only relatively low control forces for operating the valve over its entire operating range.

SUMMARY OF THE INVENTION

In a hydraulic operating mechanism for a valve which comprises a valve stem with first spring means acting on the valve stem in the valve closing direction, and second spring means acting at least intermittently on the valve stem in a valve opening direction, the compressing force of the second spring means is controlled hydraulically during the operation of the valve control device. In order to keep the control forces required for operating the valve as low as possible over its entire operating range, the second spring means comprises a spring combination composed of at least two springs which have different spring forces providing for a maximum spring force of the second spring means at the start of the valve opening stroke.

With the valve operating mechanism according to the invention, the valve actuating forces can be matched particularly well to the valve opening forces which as they are actually required. Thus, the spring combination makes it possible to generate a progressive total spring characteristic, such that particularly high spring force acts only in a first partial stroke of the valve opening movement, while a substantially lower spring force acts during the remaining valve stroke. In the engine braking mode, for example, especially high valve opening forces are required, since, in this case, the valve has to be opened at the end of the compression cycle against the high combustion chamber pressure. Because of the high combustion chamber pressure and the effective valve disc area, the valve opening forces required are orders of magnitude higher in the engine braking mode than in the engine operating mode or during the idling of the internal combustion engine.

Since such high forces are exerted only when they are actually required, while, in the remaining operating range, the spring with the lower spring force carries out the opening of the valve, the life span of the valve operating mechanism is increased and the energy required for operating the valve is decreased.

In comparison with electromagnetic valve operating mechanism, the controllable electro-hydraulic mechanism according to the invention also has other advantages stemming from the principle used, since there is no need for heavy large-size electromagnets requiring strong currents for generating the valve operating forces. In the valve operating mechanism according to the invention, electrical components are necessary only for the activation of the switches for controlling the supply of pressurized fluid to the individual pressure supply lines of the valve operating mechanism.

In the valve operating mechanism according to the invention, there is no consumption of hydraulic oil during the movement of the valve, but, instead, there is only a relatively small internal oil flow. This is advantageous particularly with regard to the valve timing and the energy consumption of the mechanism. Energy is supplied automatically predominantly when the valve is in its closed position.

Preferably, the valve operating mechanism includes a spring arrangement with a coil spring and a hydraulic spring arranged in series relationship or two coil springs arranged in parallel.

Preferably, the pre-stressing force of the second spring means is variable so that, on one hand, the energy loss occurring essentially as a result of friction during the actuation of the device can be compensated for by a retensioning of the second spring means and, on the other hand, reliable closing of the opened valve is achieved in that a pre-stressing force of the second spring means, which may possibly remain too high, can be reduced, so that the force of the first spring means can reliably carry out the valve closing movement.

Further embodiments and advantages of the invention will become apparent from the following descriptions of the invention which is explained in greater detail on the basis of two exemplary embodiments with reference to the drawings.

DESCRIPTION OF PREFERRED EMBODIMENTS

Figure 1:
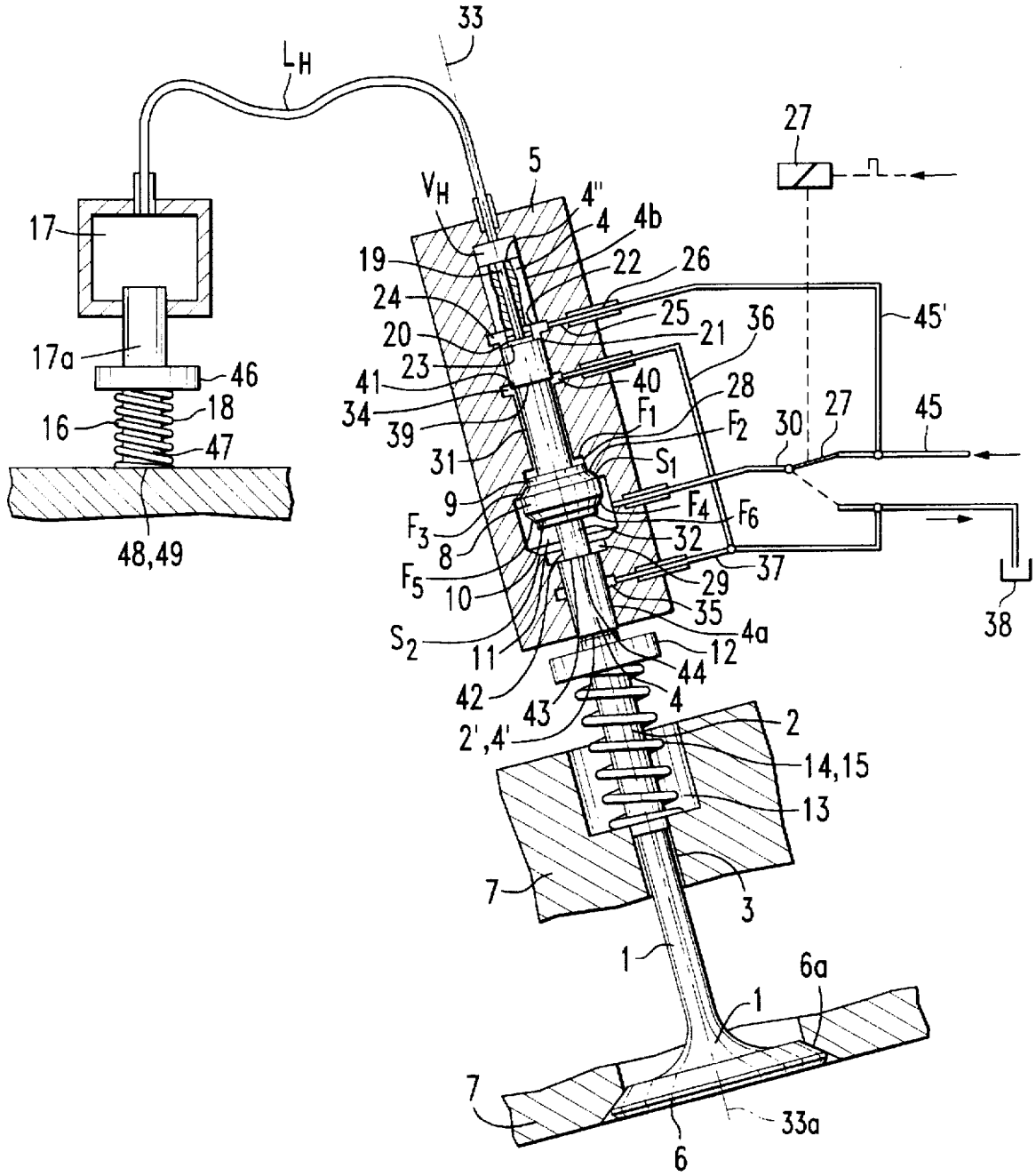
FIG. 1 shows, in a first exemplary embodiment, a controllable hydraulic valve operating mechanism of an internal combustion engine, with the valve closed, together with a first spring means acting in the valve closing direction.
Figure 2:
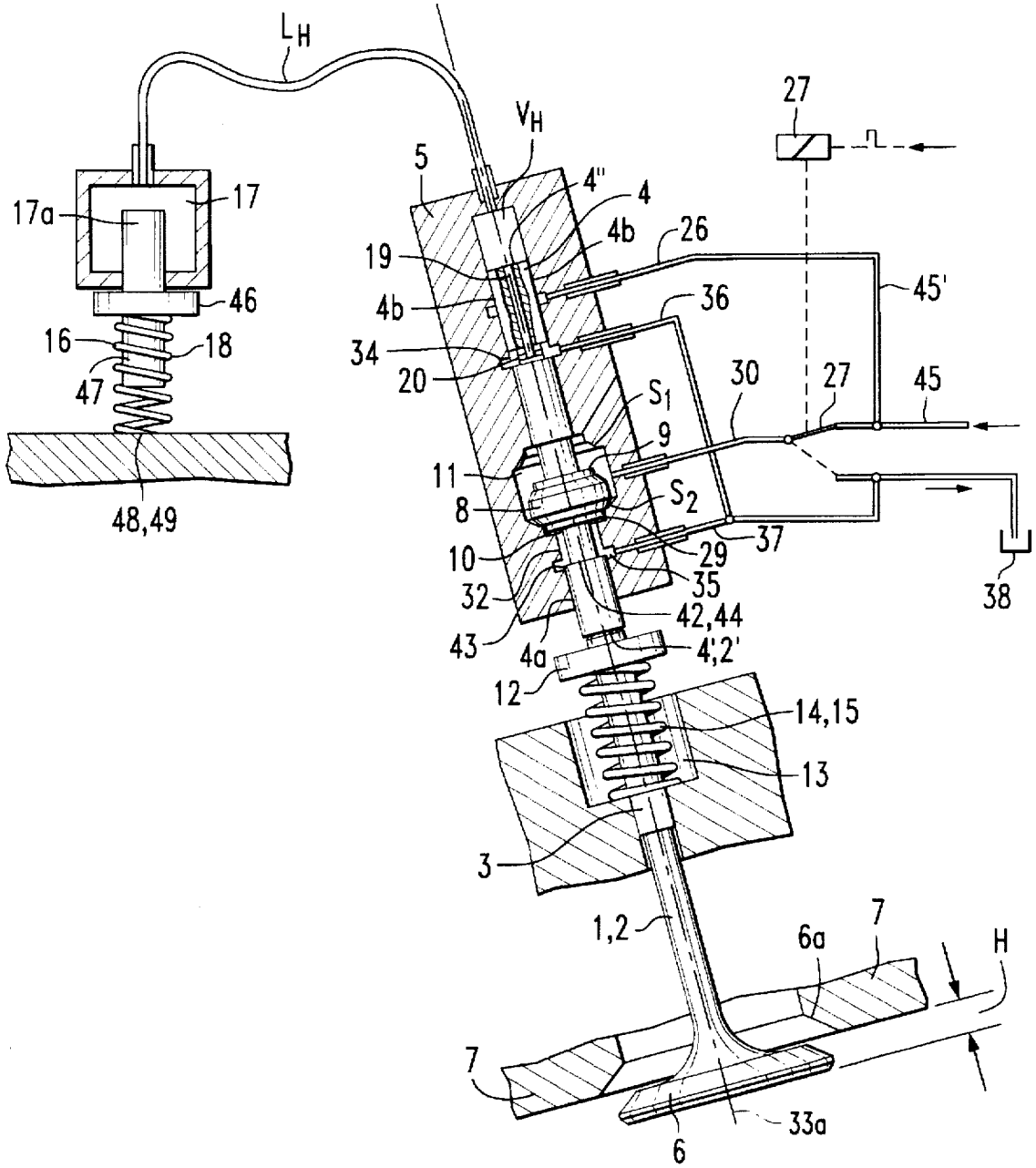
FIG. 2 shows the valve operating mechanism of FIG. 1 with the valve fully opened.

FIGS. 1 and 2 illustrate a controllable hydraulic valve operating mechanism with a valve 1 having a valve stem 2 guided in a valve guide 3 in a cylinder head 7 of an internal combustion engine which is not illustrated in detail. The valve 1 is shown in the closed position.

On the upper end face 2' of the valve stem 2, a valve tappet 4 bears with its lower end face 4' on the valve stem 2, the valve tappet 4 being guided in tappet guides 4*a* and 4*b* of a housing 5 of the internal combustion engine.

The valve 1 comprises, in addition to the valve stem 2, a valve disc 6 and a valve seat 6*a*. The valve tappet 4 comprises a control piston 8 which is described in greater detail below and which is preferably an integral part of the valve tappet 4. The control piston 8 comprises two plunger pistons 9 and 10, the plunger piston 9 being disposed on the top side and the plunger piston 10 being disposed on the bottom side of the control piston 8.

Arranged in the housing 5, between the two tappet guides 4*a* and 4*b*, is a cavity which forms a control chamber 11 for the control piston 8 together with the plunger pistons 9 and 10, the valve tappet 4 extending through the control chamber 11. A first spring means 14 acting in the valve closing direction is arranged between a spring receptacle 12 of the valve stem 2 and a spring receptacle 13 in the cylinder head 7 of the internal combustion engine. The first spring means 14 is a helical compression spring 15 which is supported between the spring receptacles 12, 13.

The valve 1 is engaged with the valve tappet by the helical compression spring 15 pressing the lifting valve 1 against the valve tappet 4, irrespective of the operating state of the valve operating mechanism.

Adjacent to the upper end face 4" of the valve tappet 4 is a hydraulic volume $V_H$ which is delimited essentially by the housing 5 and the end face 4". The hydraulic volume $V_H$ is connected via a hydraulic line $L_H$ to a second spring means 16 which acts in the valve opening direction and which comprises a series combination (spring connection) composed of an oil pressure spring 17 and the helical spring 18 (compression spring). In this case, the helical spring 18 is arranged between spring receptacles 46 and 49, the spring receptacle 46 being a spring plate, to which a rod 47 is fastened which projects from the spring receptacle 46 in the direction of the other spring receptacle 49. The helical spring 16 is disposed around the rod 47. A stop 48, on which the rod 47 abuts when the compression spring 18 is under tension, is arranged in the spring receptacle 49. The helical spring 18 (compression spring) is tensioned in that a piston 17*a* of the oil pressure 17 presses onto the spring plate 46 until the rod 47 fastened to the spring plate engages the stop 48.

The hydraulic volume $V_H$ , which forms an operating cylinder for the valve tappet 4, is in communication with a control groove 21 of the valve tappet 4 by way of pressure passages 19 and 20 extending in the valve tappet 4, the control groove having two control edges 22 and 23. The control groove 21 is intermittently connected hydraulically, in a way described in greater detail below, to a pressure duct 24 in the housing 5, the pressure duct being in the form of an annular groove extending around the valve tappet 4 and being connected to a pressure supply line 45–45' via a passage 25 and a line 26.

The control piston 8 together with the plunger pistons 9 and 10 is disposed in the control chamber such that two pressure spaces 28 and 29 are formed in the control chamber 11, one assigned to each of the plunger pistons 9 and 10. The plunger piston 9 can move into the pressure space 28 in the region of the upper end position of the control piston 8 and the plunger piston 10 can move into the pressure space 29 in the region of the lower end position of the control piston 8, with the result that the plunger piston 9 or 10 forms a partial delineation of the pressure space 28 or 29, respectively.

Located in the control chamber 11 is an operating fluid (for example, hydraulic oil, lubricating oil or fuel), the pressure of which can be controlled via a pressure source (operating-fluid pump), which is not illustrated, together with a preferably electrically operated control valve 27 and a supply line 30. In the region of the upper end position of the control piston 8, the pressure in the space 28 can be relieved of pressure into an annular pressure relief duct 34 via a connecting passage 31 (se FIG. 1) and, in the region of the lower end position of the control piston 8, the pressure space 29 can be relieved of pressure into an annular pressure relief duct 35 via a connecting duct 32 (see FIG. 2).

The movement of the plunger piston 9 or 10 into the pressure spaces 28 or 29 causes a hydraulic separation of the respective pressure space 28 or 29 from the control chamber 11. The control piston 8 together with the plunger pistons 9 and 10 can be exposed to the separating fluid in the control chamber 11 at either side.

The control piston 8 is designed in such a way that, after the removal of one of the two plunger pistons 9, 10 from the associated pressure space 28 or 29, the control chamber 11 and the two pressure spaces 28 and 29 are connected hydraulically to one another, the hydraulic connection of the two pressure spaces 28, 29 being formed by the control chamber 11 itself.

The pretension force of the second spring means 16 (series connection composed of the oil pressure spring 17 and of the helical spring 18) can be controlled, while the hydraulic valve operating mechanism is in operation, in a way described in greater detail below. When the operating fluid in the control chamber 11 is subjected to pressure and the second spring means 16 is tensioned, the first spring means 14 (helical compression spring 15) keeps the valve 1 in a closed position (see FIG. 1).

The energy loss occurring during a movement cycle can be compensated by a cyclic variation of the pre-stressing force of the second spring means 16. With the valve 1 closed, the operating pressure in the hydraulic volume $V_H$, together with the hydraulic line $L_H$ and the oil pressure spring 17, can be built up via the pressure passage 19, 20 and the control groove 21 by way of the pressure duct 24 in the form of an annular groove, together with the line 26 from the pressure supply line.

If the valve 1 is closed and is to be opened, a reduction in the oil pressure of the control chamber 11 can be controlled by way of the supply line 30 by means of the electrical switching valve 27. The switching valve 27 is connected, on the one hand, via the supply line 30 to the control chamber 11 and, on the other hand, via the pressure supply line 45–45' to the operating fluid pump and to the reservoir 38 of operating fluid.

Hydraulically effective surfaces F1–F6 of the control piston 8 of the valve tappet 4 are oriented perpendicularly or obliquely to a valve tappet axis 33, the valve tappet axis 33 coinciding preferably with an extension of the valve axis 33*a* (see FIG. 1), in order to avoid unnecessary transverse forces in the valve guide 3 or in the tappet guides 4*a* and 4*b*.

Pressure loading generates a force component which is parallel to the valve tappet axis 33 and which corresponds to the projection of the areas of the respective surface F1–F6. The hydraulically effective surfaces F1–F6 of the control piston 8 and the plunger pistons 9, 10 are of equal size and subjected to the same forces in the valve opening direction and in the valve closing direction when the control piston 8 is lifted off from the end position. The surfaces F1/F6, F2/F5 and F3/F4 are of equal size and are arranged symmetrically with respect to a plane perpendicular to the valve axis 33.

If a plunger piston 10 has moved into the pressure space 29, supplying working fluid under pressure to the control chamber 11 causes the open valve 1 (see FIG. 2) to be held in its opened position against the force of the first spring means 14 (helical compression spring 15) and a pressure possibly still present in the pressure space 29 as well as against any force on the valve disc 6 effective in the valve closing direction.

The annular pressure relief ducts 34 and 35 are located above and below the control chamber 11 and are connected in each case via a connecting line 36 or 37 to a reservoir 38 of operating fluid. The hydraulic connection between the connecting passage 31 and pressure relief duct 34 is controlled by means of a control groove 39, arranged in the valve tappet 4, together with the control edge 40. The hydraulic connection between the connecting passage 32 and the annular pressure relief duct 35 is established in a similar way by means of a control groove 42, formed in the valve tappet 2, together with the control edge 44. The connecting passages 31, 32 open into the respective control grooves 39 and 42 at points 41, 43.

In the upper end position of the control piston 8, the oblique surface F3 is pressed against a seat S1 of the control chamber 11 (see FIG. 1). Similarly, in the lower end position of the control piston 8, the oblique surface F4 is pressed against a seat S2 of the control chamber 11, with the result that the pressure space 29 is separated hydraulically from the control chamber 11 (see FIG. 2).

The series connection of the oil pressure spring 17 and helical spring 18 and the valve tappet 4 together with the control piston 8 form, together with the helical compression spring 15 and the valve 1, a spring/mass system. When the operating fluid is not pressurized, the valve 1 is always closed, since the valve disc 6 is pressed onto the valve seat 6*a* by the helical compression spring 15.

The operation of the hydraulic valve operating mechanism according to the invention is described below and explained with reference to an operating cycle, specifically first for an operating cycle of the valve operating mechanism in the engine driving mode and then for an operating cycle of the in the engine braking mode of the internal combustion engine.

For the valve opening, hydraulic operating fluid is conveyed out of the reservoir 38 by means of an operating fluid pump (not illustrated), and a supply pressure is built up, which is present at the control valve 27 via the pressure supply line 45. Irrespective of the control position of the latter, pressure loading of the line 26 with operating fluid is insured via the pressure supply line 45'.

The pressure is built up in the hydraulic volume VH, the hydraulic line LH and the oil pressure spring 17 via the line 26, the duct 25, the control groove 21 and the pressure passages 20 and 19. The oil pressure spring 17 is consequently tensioned. With the tensioning of the oil pressure spring 17, the helical spring 18 is tensioned simultaneously, in that the piston 17*a* of the oil pressure spring 17 presses onto the spring plate 46 and the helical spring 18 is thus compressed until the rod 47 fastened to the spring plate abuts the stop 48. In the driving mode of the internal combustion engine (or even, for example, during idling), in which only relatively moderate opening forces have to be exerted on the valve 1, the oil pressure spring 17 is not pre-stressed any further. In this operating phase, the oil pressure spring 17 serves merely as a means for hydraulic force transmission between the valve tappet 4 (or hydraulic volume $V_H$) and the helical compression spring 18. Consequently, only the force of the helical compression spring 18 acts on the spring/mass system.

In the engine-braking mode, however, substantially greater opening forces are necessary for opening the valve 1, since the latter now has to be opened towards the end of the compression cycle against the combustion chamber pressure. The combustion chamber pressure and the effective valve disc surface result in correspondingly high valve opening forces which can no longer be overcome by the helical compression spring 18 alone. Consequently, when the rod 47 engages the stop 48, further loading of the oil pressure spring 17 with pressure occurs, with the result that the latter is pre-stressed to a substantially greater extent than the helical compression spring 18, which cannot be compressed any further because of the stop 48. This results in the total spring characteristic (line $F_M$) illustrated in FIG. 4 and explained in greater detail below. In particular, the actuating force required to open the valve 1 and acting in the valve opening direction is thus available.

As a result of the position of the electrical switching valve 27, as illustrated in FIG. 1, pressure is likewise built up in the control space 11. The spring/mass system nevertheless remains in its upper end position (see FIG. 1), since the top side of the control piston 8 (plunger piston 9) is relieved as the pressure space 28 is in communication with the reservoir 38 of operating fluid via the connecting passage 31, the annular pressure relief duct 34 and the connecting line 36. In contrast, the pressure in the control chamber 11 is effective on the respective hydraulic surface of the control piston 8 (annular surfaces F5 and F6 perpendicular to the lifting valve axis 33 and the annular surface F4 oblique thereto). This generates a resulting counter force on the control piston 8 so that the lifting valve 1 remains closed. When the switching valve 27 is activated, the control chamber 11 is disconnected from the pressure supply and is connected to the reservoir 38. As a consequence, the effective hydraulic surface of the control piston 8 is relieved of pressure and the counterforce is reduced. The control piston 8 together with the valve tappet 4 and the valve 1 can then move from the upper end position into the lower end position.

When the plunger piston 8 has moved completely out of the pressure space 28 in the region of the upper end position of the control piston 8, the pressure space 28 and the pressure space 29 are in open communication with one another via the control chamber 11. From then on the pressure in the control chamber 11 no longer has any influence on the behavior of the control piston 8 since the critical surface F1–F6, thereof are subjected to the same pressure.

When the plunger piston 9 moves out of the pressure space 28, the valve tappet 4 closes with its control edge 40 the hydraulic connection of the pressure space 28 to the annular pressure relief duct 34. The switching valve 27 is then changed over and the control chamber 11 is again pressurized. This operation has no influence on the movement of the control piston 8. However, it is necessary to insure that the pressure build-up in the control chamber 11 has been completed before the lower end position of the control piston 8 is reached, since the pressure in the control chamber 11 is then required in order to retain the spring/mass system in its lower end position.

Shortly before the lower end position of the control piston 8 is reached, the valve tappet 4 opens with its control edge 44 the hydraulic connection between the connecting duct 32 and the annular pressure relief duct 35. The plunger piston 10 closes the connection between the control chamber 11 and pressure space 29, the different pressures on the effective hydraulic surfaces of the control piston 8 (plunger pistons 9/10) providing for a resultant force on the control piston 8 in the valve opening direction. As a result, the force biases the spring/mass system into its lower end position and retains it there with the result that the lifting valve 1 (see FIG. 2) remains open.

The energy loss occurring during the movements is compensated for by a cyclic variation of the oil-pressure spring prestressing force. This occurs in the lower end position of the spring/mass system, by the release of a still existing residual pressure in the oil pressure spring 17 via the hydraulic line $L_H$, the hydraulic volume $V_H$ and the pressure passages 19 and 20, and the control groove 21, into the annular pressure relief duct 34 (see FIG. 2). Simultaneously with the relaxation of the oil pressure spring 17, the helical compression spring 18 is also relaxed. In the lower end position of the spring/mass system, the control edge 23 of the control groove 21 is located in the region of the annular pressure relief duct 34.

The helical compression spring 15, pre-stressed to a greater extent in relation to the second spring means 16 (oil pressure spring 17 together with helical compression spring 18) insures that the upper end position of the valve 1 is reached during the return movement of the valve 1. In this case, due to the preceding reduction of residual pressure in the oil pressure spring 17, the latter is not compressed to the original initial pressure. The resulting pressure difference is therefore balanced in the upper end position of the spring/mass system (see FIG. 1), via the line 26, the passage 25, the control groove 21 and the pressure passage 19, 20 and the duct 24. This insures that, at the beginning of the next operating cycle, the oil pressure spring 17 together with the helical compression spring 18 is pre-stressed to a greater extent than the helical compression spring 15 (see FIG. 4). The energy supplied to the spring/mass system may be varied in the two end positions of the system, independently of one another, by varying the pressures between which the oil pressure spring 17 together with the helical compression spring 18 is operated. These pressure variations may be implemented by means of pressure control devices, not illustrated, for controlling the pressures prevailing in the pressure supply line 45 and in the reservoir 38.

Particularly when the engine is in an engine braking mode only the helical compression spring 18 is first tensioned during the valve return movement while the tensioning of the oil pressure spring 17 takes place in the rest position of the valve by means of a correspondingly increased hydraulic system pressure.

Figure 3:
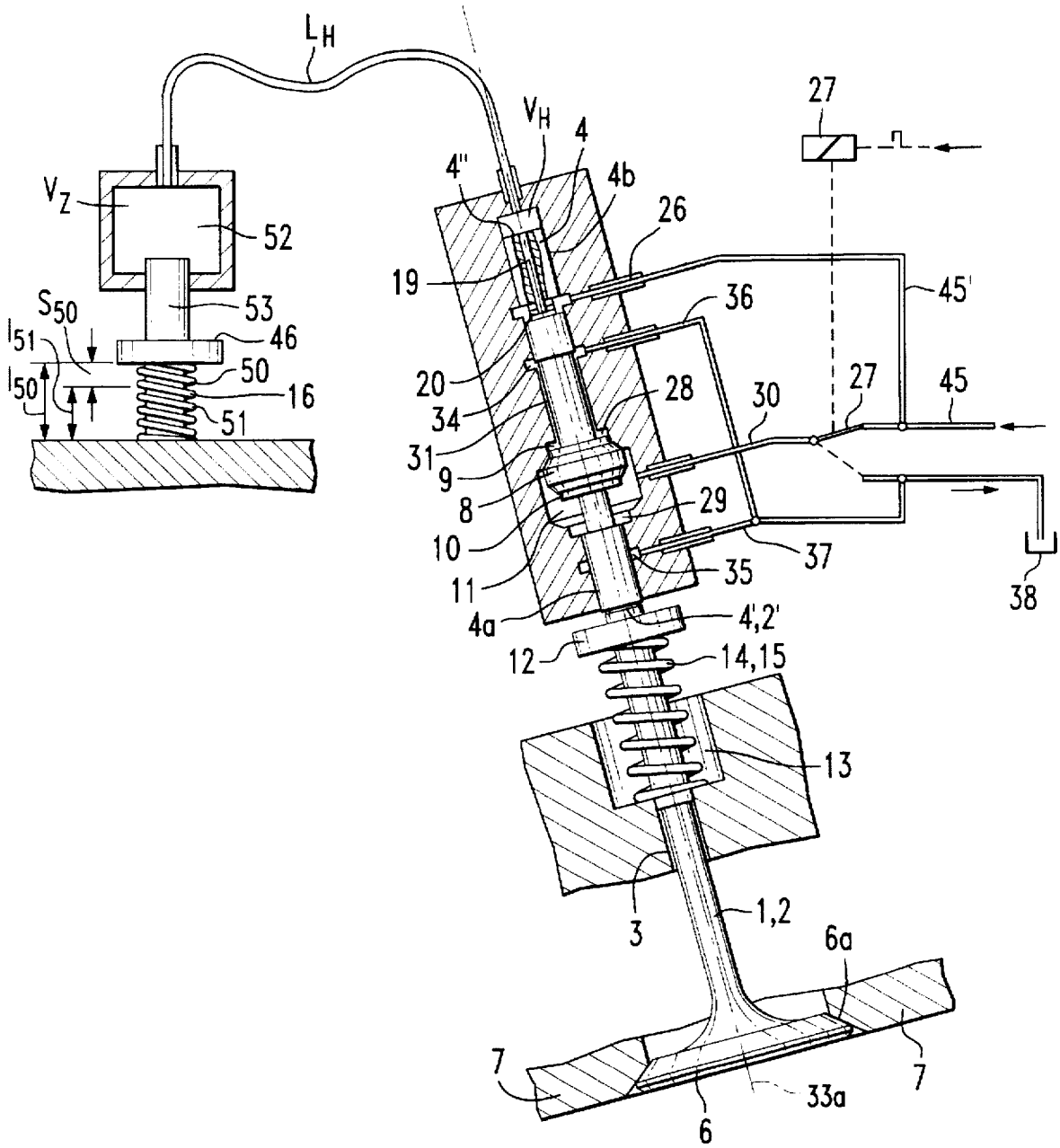
FIG. 3 shows, in a second exemplary embodiment, a valve control device similar to that of FIG. 1, wherein the second spring means consists, however, of a parallel arrangement of two coil springs disposed one within the other, and the second spring means is tensioned only after a certain compression of the first spring.

FIG. 3 shows a valve operating mechanism similar to that of FIG. 1, but in which the second spring means consists of an "intermittent" parallel connection of two helical springs 50, 51 disposed within one another. The parallel connection is described in greater detail below. Force transmission between the second spring means 16 and the valve tappet 4 takes place via a hydraulic cylinder 52 together with a hydraulic piston 53 which acts on the spring receptacle 46. The hydraulic volume $V_Z$ of the hydraulic cylinder 52 is connected via the line $V_H$ above the valve tappet 4 (see also FIGS. 1 and 2). Components similar to those of FIGS. 1 and 2 are designated by the same reference symbols.

The second helical compression spring 51 functions like the oil pressure spring of FIGS. 1 and 2. That is to say, the second helical compression spring 51 (together with the first helical compression spring 50) is pre-stressed, in the engine braking mode only, by means of a correspondingly higher pressure loading of the hydraulic volume $V_H$ while in the operational mode of the internal combustion engine, only the helical compression spring 50 is compressed.

A particular feature of this version is that a relaxed helical spring 51 has a spring length $l_{51}$ which is shorter than the spring length $l_{50}$ of the relaxed helical compression spring 50 by the amount of the spring part excursion $s_{50}$ of the helical compression spring 50. The spring part excursion $s_{50}$ of the helical compression spring 50 corresponds to the greatest spring excursion which the helical compression spring 50 executes in the driving mode or during idling of the internal combustion engine.

The second spring 51 is compressed together with the spring 50 only in the engine braking mode of the internal combustion engine. In this way the desired increase in the prestressing force of the second spring means 16 can be achieved.

Figure 4:
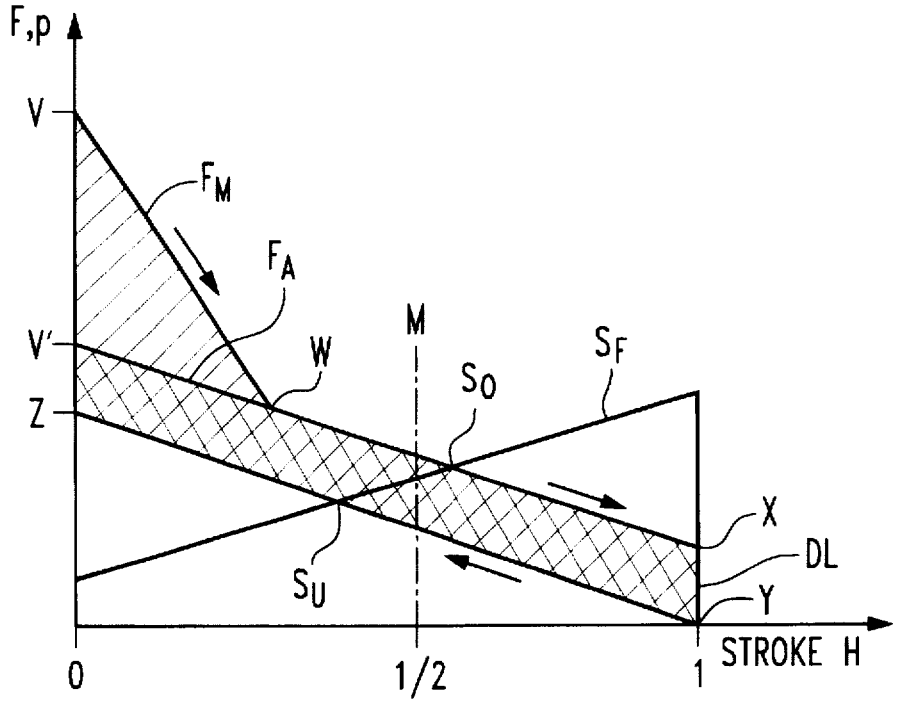
FIG. 4 shows a force and pressure diagram, applicable to the exemplary embodiments of FIGS. 1 and 3, of spring forces acting on the valve or on the valve tappet, plotted over the valve stroke for an engine operating mode and for an engine braking mode of the internal combustion engine.

FIG. 4 shows the force and pressure profiles applicable to the exemplary embodiments of FIGS. 1 and 3, of spring forces acting on the valve 1 or on the valve tappet 4 for the driving mode or idling mode (dashed-line illustration) and for the engine braking mode (unbroken-line illustration) of the internal combustion engine, plotted over the valve stroke H (see FIG. 2). In this case, the strong spring effect $F_M$ at the start of the valve movement in the engine braking mode and the relatively weak spring effect $F_A$ at the start of the valve movement in the driving mode or in the idling mode of the internal combustion engine can be seen.

During the return movement of the valve, only the weaker helical compression spring 18 or 50 is in engagement, and the stronger spring (oil pressure spring 17 or second helical compression spring 51) is compressed hydraulically by an increase in pressure, when the valve 1 is already in its closed position. The characteristic curve designated by $S_F$ shows the force profile of the helical compression spring 15 (first spring means 14) acting in the valve closing direction. The border line of the double hatched area indicates the force or pressure profile of the second spring means 16 acting in the opening direction. During the valve movement from the closed position to the open position and back again to the closed position the hatched area is transversed once in a clockwise direction from the top left-hand corner V or V' (V-W-X-Y-Z in the engine braking mode or V'-W-X-Y-Z in the driving mode of the internal combustion engine).

For the valve opening movement there is an excess force in the valve-opening direction since the intersection $S_o$ of the upper area delimitation line (characteristic of the spring force of the second spring means 16) with the characteristic line $S_F$ of the helical compression spring 15 (first spring means) is located on the right of the center position M (=half the valve stroke) . In its fully open position the valve 1 is kept open as a result of the above-mentioned relief of pressure via the annular duct 35. The line DL in FIG. 4 shows the relief of pressure of the space $V_H$, $L_Z$ and $V_Z$.

By contrast, during the valve closing movement, there is an excess force in the valve-opening direction, since the intersection $S_U$ of the lower area delimitatuion line (characteristic of the spring force of the second spring means 16) with the characteristic $S_F$ of the helical compression spring 15 is located on the left of the center position. It can thus be insured, in each case, that the corresponding movement end position is reached reliably. At the same time, the size of the hatched area is a measure of the drive energy required for an operating cycle of the valve 1.

With the valve operating mechanism according to the invention, normal valve strokes can be easily obtained with actuating times of, for example, 5–10 milliseconds with an energy consumption of about 100–250 watts (with 50 valve openings per second).

In a preferred embodiment of the invention, the operating volume of the oil pressure spring 17 comprises the hydraulic volume $V_H$ and the volume of the hydraulic line $L_H$.

In another embodiment of the invention, the line 26 may also be controlled via a further switching valve.

In the exemplary embodiment shown, the valve stem 2 and the valve tappet 4 together with the control piston 8 are designed in two parts, but the valve stem and valve tappet together with the control piston may, of course, also be designed as a single part.

In a further embodiment of the invention, the intermittent separation of the pressure spaces 28, 29 from the control chamber 11 may be carried out by means of conical or flat sealing seats which are formed between the pressure spaces 28 and 29 and the control piston 8. Also, the surfaces S1/F3 and S2/F4 could be designed as flat sealing seats instead of conical seats (as illustrated in the exemplary embodiment). No matter whether there is a conical seat or a flat sealing seat, the intermittent separation of the pressure spaces 28, 29 can be achieved solely by means of these conical or flat sealing seats, with the result that the plunger piston as described in the above exemplary embodiment is not needed.

In a further embodiment of the invention, flat sealing seats may alson be provided instead of the plunger pistons.

The above-described valve operating mechanism may be used for operating any type of valves, in particular inlet and outlet valves of internal combustion engine and piston compressors.

What is claimed is:

1. A hydraulic operating mechanism for a valve of an internal combustion engine, said valve having a valve stem slideably supported such that said valve is axially movable between a closed and an open end position, first spring means engaging said valve and biasing it into a valve closing direction, second spring means for providing a valve opening force to said valve, and hydraulic valve control and actuating means including a valve tappet arranged in axial alignment with said valve stem so as to be movable therewith and having a control piston disposed in a control chamber and movable with said valve tappet between opposite end positions in which said control piston closes opposite flow passages of said control chamber, means for admitting pressurized fluid to said control chamber for holding said piston in either of its opposite end positions to either hold the valve tappet in the open valve position or a closed valve position and means for releasing the pressurized fluid from said control chamber to either permit said first spring means to close said valve or to permit said second spring means to apply a valve opening force to said valve stem, said second spring means including hydraulic means for adjusting its pretension force including two spring structures having different spring forces which can be applied depending on an engine operating condition.

2. A valve operating mechanism according to claim 1, wherein hydraulic force transmission means are provided between said second spring means and said valve tappet.

3. A valve operating mechanism according to claim 1, wherein said second spring means includes a coil spring and a hydraulic spring structure arranged in series with said coil spring.

4. A valve operating mechanism according to claim 3, wherein said coil spring has a spring travel length which is limited by a stop.

5. A valve operating mechanism according to claim 4, wherein said hydraulic spring structure includes a spring volume with a piston engaging said coil spring for the compression of said coil spring, said hydraulic spring structure being further tensionable after said coil spring has been fully compressed to the limit given by said stop.

6. A valve operating mechanism according to claim 2, wherein said second spring means includes a parallel arrangement of a first and a second coil springs.

7. A valve operating mechanism according to claim 6, wherein said first coil spring has a smaller spring constant than said second coil spring and upon movement of said valve to its closed position, said first coil spring is compressed by said hydraulic force transmission means and said second coil spring is compressed by a further hydraulic pressure increase in the hydraulic force transmission means when said valve is closed.

8. A valve operating mechanism according to claim 1, wherein energy losses occurring during an operating cycle can be compensated via a cyclic variation of the prestressing force for said second spring means.

9. A valve operating mechanism according to claim 1, wherein, with said control piston being in a closed valve position in which it seals said control chamber, pressurized fluid in the control chamber holds the valve tappet in a valve closing position against the pressure of said second spring means and against the pressure in a pressure space outside said control chamber.

10. A valve operating mechanism according to claim 1, wherein, with the operating fluid in the working space relieved of pressure and with the second spring means relaxed, said first spring means keeps said lifting valve in a closed position.

11. A valve operating mechanism according to claim 1, wherein pressure spaces are arranged at opposite ends of said control chamber, said control piston has opposite seal surfaces to seal off an adjacent one of said pressure spaces in its opposite end position, and a fluid communication line is connected to said control chamber with switching means for connecting said communication line to a pressurized fluid supply line for holding said control piston in either of its end positions or to a fluid discharge line for releasing the fluid pressure in said control chamber to permit movement of said control piston and the associated valve from one to the opposite position, said valve tappet including a fluid flow control valve structure placing said second spring means in communication with said pressurized fluid supply line when said valve is in a closed position for charging said second spring means and placing it in communication with said fluid discharge line when said valve is in the open valve position.

* * * * *